US007619528B2

(12) United States Patent
Kobres

(10) Patent No.: US 7,619,528 B2
(45) Date of Patent: Nov. 17, 2009

(54) METHODS AND APPARATUS FOR DETECTING AND IDENTIFYING IMPROPER ANTITHEFT DEVICE DEACTIVATION

(75) Inventor: Erick Christian Kobres, Lawrenceville, GA (US)

(73) Assignee: NCR Corporation, Dayton, OH (US)

( * ) Notice: Subject to any disclaimer, the term of this patent is extended or adjusted under 35 U.S.C. 154(b) by 444 days.

(21) Appl. No.: 11/552,174

(22) Filed: Oct. 24, 2006

(65) Prior Publication Data

US 2008/0094218 A1 Apr. 24, 2008

(51) Int. Cl.
*G08B 13/14* (2006.01)

(52) U.S. Cl. ..... 340/572.3; 340/572.1; 340/540; 235/375

(58) Field of Classification Search ..... 340/572.3, 340/572.1, 825.54, 825.32, 540, 10.1; 705/28; 364/478.03, 478.13, 478.15; 235/375, 382.5, 235/385, 383; 455/83
See application file for complete search history.

(56) References Cited

U.S. PATENT DOCUMENTS

| | | | | |
|---|---|---|---|---|
| 5,745,036 | A * | 4/1998 | Clare | 340/572.1 |
| 6,025,780 | A * | 2/2000 | Bowers et al. | 340/572.3 |
| 6,333,692 | B1 * | 12/2001 | Andersen et al. | 340/572.1 |
| 6,476,720 | B2 * | 11/2002 | Andersen et al. | 340/572.1 |
| 6,809,645 | B1 * | 10/2004 | Mason | 340/572.1 |
| 7,170,414 | B2 * | 1/2007 | Clifford et al. | 340/572.3 |
| 7,495,564 | B2 * | 2/2009 | Harold et al. | 340/572.3 |
| 2002/0011933 | A1 * | 1/2002 | Andersen et al. | 340/572.1 |
| 2002/0105424 | A1 * | 8/2002 | Alicot et al. | 340/572.1 |
| 2003/0075602 | A1 * | 4/2003 | Wike et al. | 235/383 |
| 2004/0113791 | A1 * | 6/2004 | Salim et al. | 340/572.3 |
| 2005/0040950 | A1 * | 2/2005 | Clucas | 340/572.1 |
| 2005/0219053 | A1 * | 10/2005 | Clifford et al. | 340/572.4 |
| 2006/0175402 | A1 * | 8/2006 | Maitin | 235/383 |
| 2007/0008102 | A1 * | 1/2007 | Fallin et al. | 340/506 |
| 2007/0210922 | A1 * | 9/2007 | Clifford et al. | 340/572.3 |
| 2008/0065496 | A1 * | 3/2008 | Fowler et al. | 705/16 |

FOREIGN PATENT DOCUMENTS

| | | |
|---|---|---|
| EP | 1 429 301 | 6/2004 |
| WO | WO 02/071346 | 9/2002 |

* cited by examiner

*Primary Examiner*—Davetta W Goins
*Assistant Examiner*—Hoi C Lau
(74) *Attorney, Agent, or Firm*—Priest & Goldstein, PLLC; Paul W. Martin

(57) ABSTRACT

Systems and techniques for retail product transaction processing and security tag deactivation analysis. Upon detection of a security tag deactivation associated with entry of product information into a retail transaction, product information for the product is analyzed to determine whether the security tag deactivation is legitimate or possibly illegitimate. Upon identification of a deactivation as possibly illegitimate, an alert is issued to a retailer employee to investigate the transaction. The product information may be updated according to an entry made by the retailer employee identifying the deactivation as legitimate or illegitimate. Product information for a product may include a deactivation count for a product, with a deactivation being identified as possibly illegitimate if the deactivation count does not meet a predefined threshold, the deactivation count being incremented if a deactivation identified as unexpected is determined to be legitimate.

14 Claims, 3 Drawing Sheets

METHODS AND APPARATUS FOR DETECTING AND IDENTIFYING IMPROPER ANTITHEFT DEVICE DEACTIVATION

FIELD OF THE INVENTION

The present invention relates generally to improvements to retail point of sale systems. More particularly, the invention relates to improved systems and techniques for detecting deactivation of antitheft devices and appropriately identifying improper deactivations.

BACKGROUND OF THE INVENTION

Self service checkout systems are widely used in retailing, and provide opportunities for significant labor savings by merchants. However, the use of such systems, unless properly managed, provides increased opportunities for theft by unscrupulous customers. In order to provide for efficient and profitable use and customer satisfaction, self service systems must be able to reduce opportunities for undetected theft while avoiding excessive referral of transactions to human operators. In addition, employee operated checkout systems may also provide opportunities for an unscrupulous customer to engage in theft by altering product identification or security features of products or their packaging without detection by an employee operating a checkout station.

One commonly used mechanism for preventing costly thefts is the use of security tags. Security tags are often used on high priced or easily concealed products, but may be used on any desired product. A tag is affixed to a product or its packaging in such a way that the tag is difficult to remove. The tag typically triggers an alarm when carried past a checkpoint unless it is first deactivated.

Security tags are typically deactivated by passing them through a magnetic field generated by a deactivation device. The magnetic field through which the tags pass may extend some distance, such as several inches, from the deactivation device. One way for a thief to steal a high priced product is by concealing the product within a larger, typically lower cost, product. For example, a thief might conceal a personal audio player inside a substantially larger product, such as a storage container. Self checkout systems typically include weight matching features in order to detect attempts at theft. Such weight matching allows for deviations, within some tolerance, between a weight reading and an expected weight. If a smaller product is concealed within a substantially larger product, in this case, the personal audio player within the storage container, the deviation in weight reading caused by the presence of the smaller product may not be detected by a weight matching feature. If the checkout station includes a deactivation device that is always operating or that operates whenever a product is entered into a transaction, the thief may purchase the suitcase and deactivate a tag affixed to the personal audio player concealed within the suitcase. The thief would be able to deactivate the tag without detection and without entering the personal audio player into the transaction.

Another strategy used by thieves is to falsify a bar code attached to a product presented for purchase. Such falsification may be accomplished by creating a false bar code, or by taking a bar code from another product. The falsified bar code typically identifies a product having a similar weight to, but a lower price than, the product to which the bar code is fraudulently attached. Such a scheme allows a customer to fraudulently avoid paying the correct price for the product.

SUMMARY OF THE INVENTION

The present invention addresses such difficulties by providing an automatic mechanism for detecting deactivations of security tags during a transaction and associating each detection of a deactivation with the product being entered into a transaction. Each of a plurality of self service and employee operated checkout stations may be used to enter product information into transactions and deactivate security tags when necessary. A centralized repository of product information is maintained, with records being maintained and stored relating to the presence or absence of security tags for each product. Such records may include explicit identifications of products as bearing or lacking security tags. As an alternative or in addition, records may reflect the result of a learning process. In such a learning process, a deactivation count may be kept for each product, with the deactivation count being the number of deactivations detected in association with purchases of the product. Until a predetermined number of deactivations has been detected, the detection of a deactivation in connection with an entry of a product into a transaction may give rise to investigation, but once that predetermined number of deactivations has been detected, a subsequent deactivation may be deemed not to call for an investigation. In order to enhance or shorten the learning process, a retailer employee investigating a transaction may simply enter a notation that a product bears or does not bear a security tag, if this information is known. Such an entry would typically terminate the learning process, and cause the product information to be updated with the entered information relating to the presence or absence of a tag.

When a product is presented for entry into a transaction and a deactivation of a security tag is detected, product information is examined and evaluated to determine if the product is expected to bear a security tag. If the product information does not indicate that the product is expected to bear a security tag, an alert is issued to a retailer employee, allowing the employee to investigate the transaction, and also to update the product information to indicate whether or not a tag should be expected to be present, if this information is known to or easily determined by the employee.

A more complete understanding of the present invention, as well as further features and advantages of the invention, will be apparent from the following Detailed Description and the accompanying drawings.

DETAILED DESCRIPTION

Figure 1:
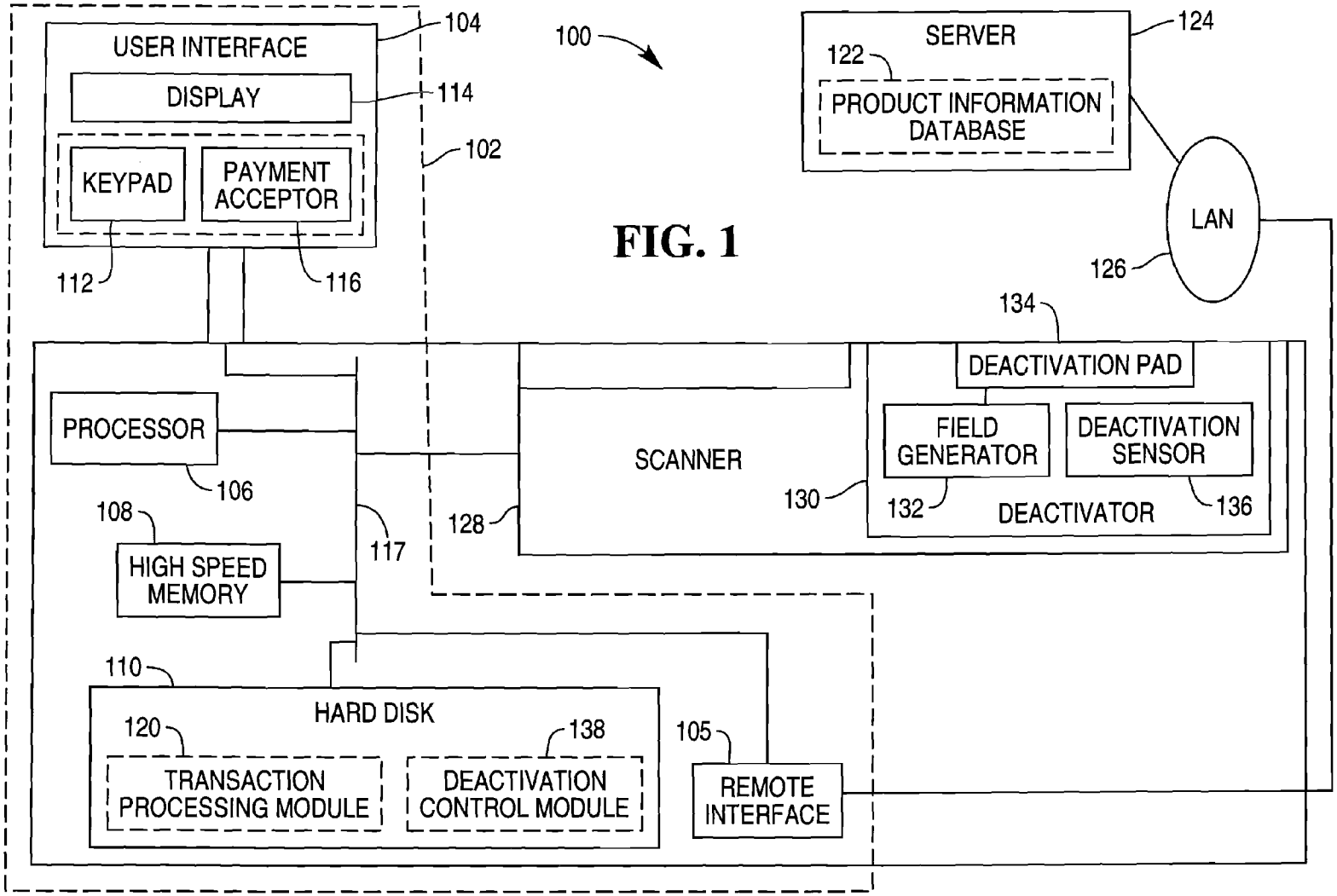
FIG. 1 illustrates a checkout station according to an aspect of the present invention.
Figure 2A:
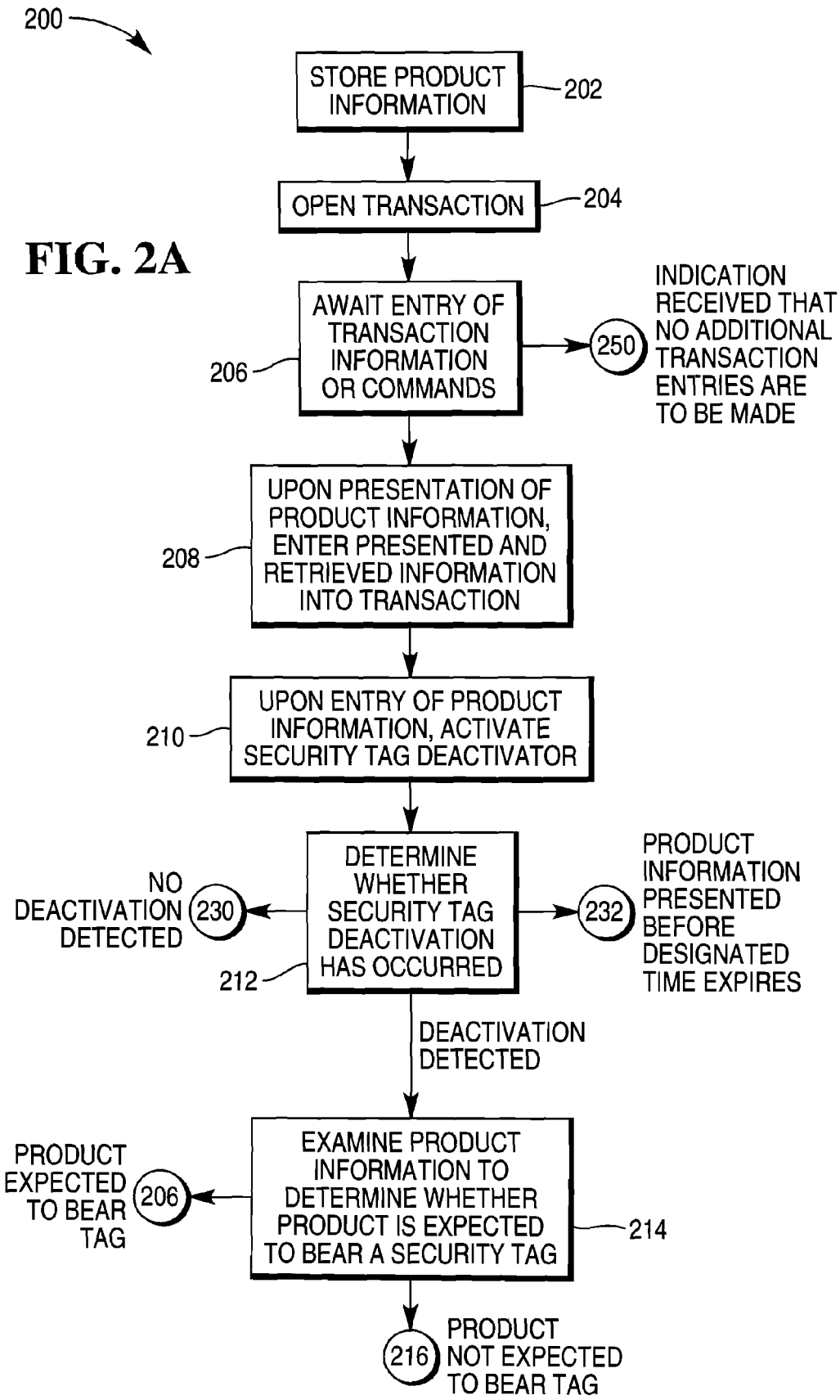
FIGS. 2A-2D illustrate the steps of a process of transaction processing and deactivation detection and analysis according to an aspect of the present invention.
Figure 2B:
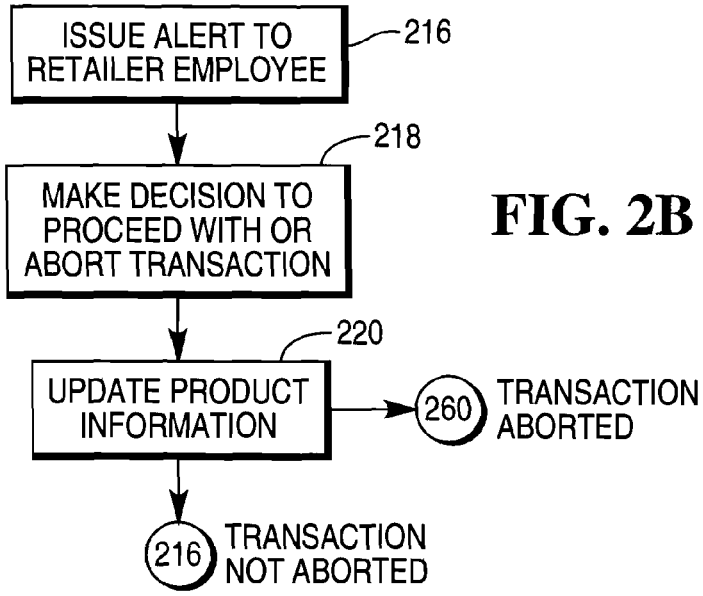
Figure 2C:
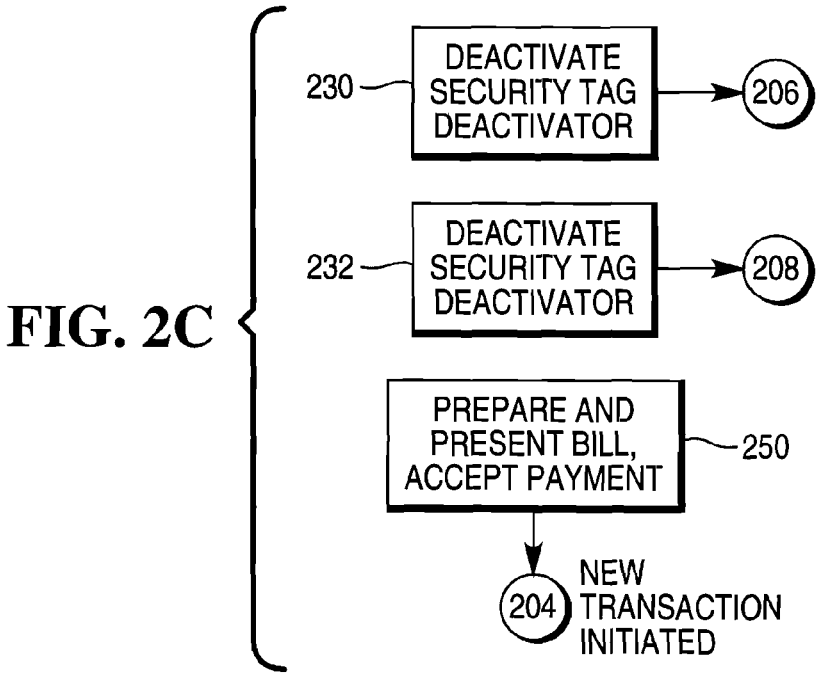
Figure 2D:
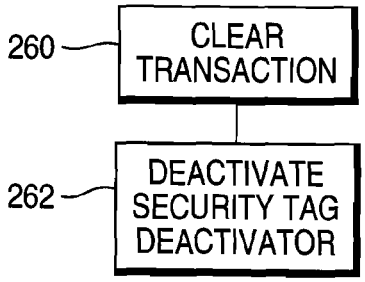

FIG. 1 illustrates a checkout station 100 according to an aspect of the present invention. The checkout station 100 includes a transaction processing device 102 which in turn includes a user interface 104 and a remote interface 105, as well as data processing elements including a processor 106, high speed memory 108 and long term storage such as a hard disk 110. The user interface 104 includes a keypad 112, a display 114 and a payment acceptor 116, allowing a customer to tender payment by one or more of various means such as cash, a check, a credit card, debit card, gift card, or the like. The various components of the transaction processing device 102 may suitably communicate with one another and with additional devices using a bus 117 and connections provided thereby.

The checkout station 100 employs a transaction processing module 120, suitably implemented as software hosted on the hard disk 110 and transferred to high speed memory 108 as needed for execution by the processor 106. The transaction processing module 120 receives user inputs and product information, such as scanned bar code information, product weight, and stored product information, in order to carry out transactions. The transaction processing module 120 may retrieve stored product identification, such as product identification and price information, from a product information database 122, suitably hosted on a remote device, such as a server 124. The checkout station 100 suitably communicates with the server 124 through a local area network (LAN) 126. The transaction processing module 120 may also direct the sending and receiving of financial information, such as credit and debit card authorization and check verification, through a remote device such as the server 124.

The checkout station 100 further includes a scanner 128 and a security tag deactivator 130. The deactivator 130 may be embedded within the scanner 128, and may suitably include a deactivation field generator 132, a deactivation pad 134 from which a deactivation field produced by the generator 130 is emitted, and a deactivation sensor 136.

When a security tag is brought within a deactivation field emitted by the generator 132, the field acts to deactivate security coding characterizing the security tag. The deactivation causes detectable perturbations of the deactivation field, and these perturbations can be sensed by the deactivation sensor 136. Suitably, the operation of the security tag deactivator 130 is controlled and monitored by a deactivation control module 138. The deactivation control module 138 is shown here as being hosted on the hard disk 110 and executed by the processor 106, but may alternatively be stored and executed using data processing hardware implemented as part of the deactivator 126.

The deactivation control module 138 suitably receives information indicating the sensing of perturbations by the deactivation sensor 136, and interprets the information to identify occurrences of tag deactivations. Whenever a tag deactivation is detected, a tag deactivation indicator is passed to the transaction processing module 120.

Typically, the security tag deactivator 130 is activated when a product is scanned or otherwise entered into a transaction. Upon successful entry of a product into a transaction, the transaction processing module 120 passes an indication of a successful entry to the deactivation control module 138. The deactivation control module 138 directs activation of the security tag deactivator 130 and receives and interprets any incoming information relating to perturbations of the deactivation field in order to detect deactivation of a tag. If deactivation of a tag is detected, the deactivation control module 138 passes a tag deactivation indicator to the transaction processing module 120.

Upon receiving a tag deactivation indicator after product identification information has been entered into a transaction, for example, through scanning a bar code or through manual entry of information, the transaction processing module 120 examines information for the product to determine whether or not a security tag deactivation is to be expected for the product. The information may suitably be stored in the product information database 122 hosted on the server 124. As noted above, the product information suitably includes product identification and pricing information. In addition, the product information suitably includes information relating to the expected presence or absence of security tags on a product. The product information relating to the presence or absence of security tags may include information relating to one or more of numerous different conditions that may be evaluated to determine if a deactivation is to be expected.

For example, stored information for a product may include an explicit notation as to whether or not the product or its packaging bears a security tag. Alternatively or in addition, detected security tag deactivations may be tracked for each product. A stored record or entry for each product may therefore include a deactivation count indicating the number of times a security tag deactivation has been detected in association with a presentation of that for entry into a transaction. If the deactivation count does not meet a predefined threshold, a deactivation may be identified as unexpected.

When an unexpected deactivation is detected for a product, an alert is suitably issued to a retailer employee to investigate the transaction. In addition to investigating whether an attempted theft is taking place, the retailer employee may also determine whether or not the product that was entered into the transaction bears a security tag, so that a security tag deactivation is to be expected. The retailer employee may suitably make an appropriate entry using the interface 102, and the stored information for the product is updated to reflect the information entered by the retailer employee. For example, an entry may be made indicating that the product does not bear a security tag and that any deactivation is to be investigated, or that the product does bear a tag and that a deactivation is not suspicious.

To take a specific example, suppose that a dishonest customer has concealed a personal audio player bearing a security tag inside a storage container that does not bear a security tag. The customer takes the storage container to a self-checkout station and scans a bar code attached to the storage container. Information for the storage container is entered into the transaction, and the transaction processing module 120 passes a notification of the transaction entry to the deactivation control module 138. The deactivation control module 138 directs activation of the deactivator 130. The customer passes the storage container over the deactivation pad 134, and the security tag attached to the personal audio player is deactivated because the field produced by the deactivation field generator 132 passes through the storage container to reach the security tag affixed to the audio player concealed inside the storage container.

The deactivation of the security tag causes a perturbation in the deactivation field. This perturbation is sensed by the deactivation sensor 136. The deactivation sensor 136 identifies a tag deactivation and passes an appropriate indicator to the deactivation control module 138. The deactivation control module deactivates the security tag deactivator 130 and passes to the transaction processing module 120 an indication that a security tag deactivation has been detected.

The transaction processing module 120 retrieves information relating to the storage container from the product information database 122. Suppose that the information does not include any explicit notation as to the presence or absence of a security tag. The transaction processing module 120 then further examines the information to determine whether an entry for the storage container includes a deactivation count, comparing the value of the deactivation count against a predetermined threshold number. In the present exemplary case, the threshold number is 5. No previous tag deactivations have been detected in conjunction with the purchase of the storage container, so an alert is issued to a retailer employee to investigate the transaction. The retailer employee examines the storage container and discovers the concealed audio player.

The retailer employee further inspects the storage container to determine whether a security tag is affixed to the storage container. In the present exemplary case, no security tag is affixed to the storage container.

At this point, it can be presumed that the detected deactivation resulted from a deactivation of the security tag affixed to the audio player, not from any security tag affixed to the storage container. If the retailer employee knows, or can easily determine, that no security tag is associated with the storage container, the employee may enter a notation in the product information for the storage container that no security tag is to be associated with the storage container. If this information is not known, the employee may simply make an entry indicating that the detected security tag deactivation was not legitimate, so that the transaction processing module 120 will not count a deactivation associated with the storage container and therefore will not create or increment a deactivation count associated with the storage container.

To take another example, suppose that a retailer has introduced a new brand of perfume with packaging bearing security tags. The retailer has entered product identification, price, and weight information into the database 122, but has not entered any information about the presence or absence of security tags. When a customer legitimately presents the perfume for purchase and the tag is deactivated, the transaction processing module 120 examines the product information and detects that no deactivation count has been created for this product. The transaction processing module 120 may either issue a security alert or, optionally, silently learn that the previously unobserved item contains a security tag and issue no alert. Such learning may be accomplished by taking appropriate considerations into account. For example, if a product, such as the perfume of the present example has a relatively high price, the transaction processing module 120 may recognize a relatively high likelihood that such a product will bear a security tag and recognize that the presence of a security tag is to be expected.

In the case where an alert is issued, a retailer employee investigates the transaction, determines that the transaction and deactivation are legitimate, and makes an appropriate entry. In either case, the transaction processing module 120 updates the product information to create a deactivation count for the product, with a value of "1," and stores the updated value in the product information database 122. Whenever the identical perfume is presented for purchase, with the deactivation count being incremented each time, until the deactivation count has reached a predefined threshold. After this threshold has been reached, the transaction processing module 120 no longer issues a security alert when a deactivation is detected in association with a presentation of the perfume for purchase.

FIGS. 2A-2D illustrate the steps of a process 200 of transaction processing and security tag deactivation analysis according to an aspect of the present invention. The illustration of the process spans multiple figures for ease of viewing. At step 202, product information relating to each of a plurality of products offered for sale by a retailer is stored, suitably in a product information database. The product information includes a record for each unique category of product offered for sale. Categories may include a unit of a product belonging to a specific brand and model, such as a video disc recorder. Other categories may include a package containing a specified quantity of a particular product, such as a factory sealed package of 25 recordable videodiscs. Numerous other categories may be defined, with information stored for each category. The product information may also include information relating to the presence or absence of security tags on the product or on the product's packaging. This information may include explicit notations that a product bears or does not bear a security tag. Alternatively or in addition, the information may include records of detected security tag deactivations associated with transactions involving the product.

At step 204, upon initiation of a transaction at a transaction processing station, a transaction is opened. At step 206, entry of transaction information or commands is awaited. Entry of transaction information may include entry of product information for entry into a transaction. Entry of commands may include an indication that no additional transaction entries are to be made. If a command has been entered indicating that no additional transaction entries are to be made, the process skips to step 250. Otherwise, the process proceeds to step 208.

At step 208, upon presentation of transaction information for a product, the product information, as well as additional relevant product information retrieved from a central storage source, is entered into the transaction. At step 210, upon entry of the product information into the transaction, a security tag deactivator is activated. At step 212, phenomena such as deactivation field perturbations are sensed in order to determine whether a security tag deactivation has occurred. If no deactivation has occurred within a designated time, the process skips to step 230 and the security tag deactivator is deactivated. The process then returns to step 206. Returning to step 212, if no deactivation has occurred, but transaction entry for a product is presented before the designated time expires, the process skips to step 232, the security tag deactivator is deactivated and the process returns to step 208.

Returning again to step 212, if a deactivation is detected, the process proceeds to step 214. At step 214, product information for the product is examined to determine whether or not the product is expected to bear a security tag. Such information may include a specific designation or a record of how many detected deactivations have been associated with the product, and may also include information useful for automated learning, for example, whether the price and size information for the product indicates whether the product is more or less likely to bear a security tag, and the examination and analysis using such information may include automated learning if the number of detected deactivations is small, or if no previous deactivation has been detected for the product.

If the product information, and the examination and analysis of the information, indicates that a security tag deactivation is expected, the process returns to step 206. If the product information indicates that the product is not expected to bear a tag, indicating that a security tag deactivation may be illegitimate, the process proceeds to step 216. At step 216, an alert is issued to an employee, requesting the employee to investigate the transaction.

Next, at step 218, upon employee investigation of the transaction and entry of appropriate information, the decision is made to proceed with or to abort the transaction, depending on the outcome of the investigation. At step 220, the product information for the product is updated according to any entries made by the employee. For example, an employee may make an entry explicitly defining a security tag deactivation for the product as expected or unexpected, or may make an entry allowing or preventing the addition of recognition of a deactivation to a running tally of such recognitions in association with the product. If the transaction has been aborted, the process skips to step 260. At step 260, the transaction is cleared. The process then terminates at step 262. If the transaction has not been aborted, the process returns to step 206.

Step 250 is, as noted above, reached from step 206 once an indication has been received that no additional transactions are to be made. At step 250, an itemized bill or receipt is prepared for presentation to the customer and payment is accepted from the customer. The presentation of the bill or receipt and acceptance of payment may be accomplished manually in the case of employee operated stations or automatically in the case of self checkout stations. The process then returns to step 204 upon initiation of a new transaction, for example, by a new customer.

While the present invention is disclosed in the context of a presently preferred embodiment, it will be recognized that a wide variety of implementations may be employed by persons of ordinary skill in the art consistent with the above discussion and the claims which follow below.

I claim:

1. A retail checkout terminal, comprising:

a security tag deactivation device for deactivating a security tag affixed to a product presented for entry into a transaction;

a deactivation detector for detecting a deactivation of the security tag; and a processor for receiving a deactivation detection indication from the deactivation detector that a security tag has been deactivated and evaluating the deactivation detection indication in light of information associated with the product to determine if deactivation of a security tag is to be expected for a transaction involving the product, wherein the processor is operative to access a repository for product information, the product information including an entry for each product that may be submitted for entry into a transaction, the processor being operative to examine each entry for information indicating whether a deactivation of a security tag is to be expected for a transaction involving the product, and wherein one or more product entries may include a deactivation count indicating a number of times a deactivation has been detected in association with a transaction entry associated with the product, wherein the processor is operative to evaluate a deactivation associated with a product as expected if the deactivation count for the product meets a predefined threshold and wherein the processor is operative to evaluate the deactivation associated with the product as unexpected if the deactivation count for the product does not meet the predefined threshold.

2. The checkout terminal of claim 1, wherein the processor is operative to make a decision as to whether an unexpected deactivation is legitimate or may be illegitimate.

3. The checkout terminal of claim 2, wherein the processor is operative to issue an alert to a retailer employee upon determining that a deactivation may be illegitimate.

4. The checkout terminal of claim 2, wherein the processor is operative to update the deactivation count for a product if a deactivation is determined to be unexpected but no determination is made that the deactivation may be illegitimate.

5. The checkout terminal of claim 1, wherein one or more product entries may include explicit information indicating whether or not the product bears a security tag.

6. The checkout terminal of claim 5, wherein the processor is operative to receive an entry from a retailer employee indicating whether or not a product bears a security tag and to update the product entry for the product based on the entry from the retailer employee.

7. The checkout terminal of claim 5, wherein the processor is operative to perform automated learning when a deactivation is detected in connection with a product for which no previous deactivation has been detected, in order to establish an expectation as to whether a deactivation is or is not to be expected in connection with transactions involving the product.

8. The checkout terminal of claim 7, wherein the automated learning takes into account information relating to a product and associated with a greater or lesser likelihood that such a product will bear a security tag.

9. A method of transaction processing and security tag deactivation analysis, comprising the steps of:

receiving an indication of a security tag deactivation in association with presentation of information for a product for entry into a transaction;

analyzing product information for the product to determine whether or not the security tag deactivation is unexpected including comparing a deactivation count for detected deactivations associated with the product to determine whether the deactivation count meets a predefined threshold and identifying the deactivation as unexpected if the deactivation count does not meet the threshold;

analyzing the product information for the product to determine whether an unexpected deactivation is legitimate or illegitimate; and alerting a retailer employee to investigate the transaction if the deactivation is identified as illegitimate including receiving an entry from a retailer employee indicating whether the deactivation is in fact legitimate or illegitimate and updating the deactivation count for the product if the entry indicates that the deactivation is legitimate.

10. The method of claim 9, wherein the step of alerting the retailer employee includes receiving an entry from the retailer employee indicating whether or not the product bears a security tag and updating the product information in accordance with the entry.

11. The method of claim 9, wherein the step of receiving the deactivation indication is preceded by a step of storing product information for a plurality of products for which product information may be entered into a transaction, the product information for one or more products including information that may be analyzed to determine whether a security tag deactivation associated with the product is expected or unexpected.

12. The method of claim 11, wherein the information that may be analyzed includes price information for the product.

13. The method of claim 12, wherein the information that may be analyzed includes size information for the product.

14. The method of claim 11, wherein the product information includes an explicit indication for one or more products that the product bears or does not bear a security tag.

* * * * *